US012723396B2

(12) United States Patent
Whidden

(10) Patent No.: US 12,723,396 B2
(45) Date of Patent: Sep. 1, 2026

(54) FRAMING BRACKET

(71) Applicant: Rod Whidden, Niagara Falls (CA)

(72) Inventor: Rod Whidden, Niagara Falls (CA)

( * ) Notice: Subject to any disclaimer, the term of this patent is extended or adjusted under 35 U.S.C. 154(b) by 415 days.

(21) Appl. No.: 18/342,297

(22) Filed: Jun. 27, 2023

(65) Prior Publication Data

US 2025/0003210 A1 Jan. 2, 2025

(51) Int. Cl.
*E04B 1/26* (2006.01)

(52) U.S. Cl.
CPC .... *E04B 1/2608* (2013.01); *E04B 2001/2644* (2013.01); *E04B 2001/266* (2013.01)

(58) Field of Classification Search
CPC ..... E04B 1/2608; E04B 2001/2644; E04B 2001/266
See application file for complete search history.

(56) References Cited

U.S. PATENT DOCUMENTS 1,074,242 A * 9/1913 Caldwell ..... E04B 2/723 52/354
2,638,643 A * 5/1953 Olson ..... E04B 1/2608 428/575
2,666,238 A * 1/1954 Hagedorn ..... E04B 1/2608 403/189
4,330,971 A 5/1982 Auberger
4,527,375 A 7/1985 Braginetz
5,143,472 A * 9/1992 Reed ..... E04F 11/1812 403/403
5,678,379 A * 10/1997 Quattrociocchi ..... E04B 1/2608 403/231
D387,970 S 12/1997 Enslen
5,794,395 A * 8/1998 Reed ..... E04H 12/2261 52/712
6,088,982 A * 7/2000 Hiesberger ..... E04B 1/2608 403/231
6,290,214 B1 9/2001 DeSouza
6,694,700 B1 * 2/2004 Mackett ..... E04B 1/0046 411/404
7,427,055 B2 * 9/2008 Platt ..... E04H 17/1488 256/65.05
D619,879 S 7/2010 McCarthy et al.
7,856,763 B2 * 12/2010 Keys ..... F16B 9/052 52/93.2
7,971,410 B2 * 7/2011 Jerke ..... E04H 9/14 52/703

(Continued)

*Primary Examiner* — Rodney Mintz
(74) *Attorney, Agent, or Firm* — Gowling WLG (Canada) LLP

(57) ABSTRACT

The present invention relates to a novel framing bracket. The framing bracket comprises a housing which in turn comprising sides which define an enclosed perimeter and first and second openings. The framing bracket also comprises at least two pairs of opposing fastening wings which extend from the opposing sides of the second opening. The first pair of opposing fastening wings extend from the first pair of opposing sides of the first opening at an angle to the side of the housing. The second pair of opposing fastening wings extend from the second pair of opposing sides of the second opening along the same plane as the side of the second pair of opposing sides. The pairs of first and second fastening wings are oriented such that they are essentially perpendicular to each other.

15 Claims, 3 Drawing Sheets

(56) References Cited

U.S. PATENT DOCUMENTS 8,397,470 B2 * 3/2013 Summons ..... E04D 12/00 52/700
8,474,217 B2 * 7/2013 Paton ..... E04G 21/16 52/749.1
8,540,201 B2 9/2013 Gadd et al.
8,713,872 B2 * 5/2014 Rempel ..... E04B 1/2608 52/573.1
8,966,857 B2 * 3/2015 Pope ..... F16B 9/052 52/696
10,294,656 B2 * 5/2019 Fox ..... E04B 1/2403
11,236,503 B2 * 2/2022 Fox ..... E04B 1/2604
11,781,309 B2 * 10/2023 Pellock ..... E04B 1/2608 52/696
2006/0283106 A1 * 12/2006 Totin ..... E04B 1/2604 52/127.6
2007/0131920 A1 6/2007 Platt
2007/0209312 A1 * 9/2007 Keys ..... F16B 9/052 52/696
2009/0178362 A1 * 7/2009 Jerke ..... E04H 9/14 52/656.9
2010/0243831 A1 * 9/2010 Gadd ..... E04B 1/2612 248/200
2011/0214389 A1 9/2011 Paton
2012/0159892 A1 * 6/2012 Summons ..... E04D 12/00 52/700
2012/0297721 A1 * 11/2012 Rempel ..... E04B 1/2608 52/655.1
2012/0297724 A1 * 11/2012 Pope ..... E04B 1/2612 52/702
2018/0363287 A1 * 12/2018 Fox ..... E04B 1/2612
2019/0271146 A1 * 9/2019 Fox ..... E04B 1/2604
2020/0199861 A1 * 6/2020 Fox ..... E04B 1/2604
2022/0136230 A1 * 5/2022 Pellock ..... E04B 1/2608 52/696
2023/0151603 A1 * 5/2023 Irion ..... E04B 1/2604 403/265

* cited by examiner

FRAMING BRACKET

FIELD OF INVENTION

The present invention generally relates to framing brackets, and in particular, to framing brackets comprising an enclosed housing adapted to received a piece of lumber.

BACKGROUND OF THE INVENTION

Professionals and amateur builders alike use brackets to connect pieces of lumber, including studs, posts, joists or any other manner of support beam. Whether the piece of lumber is to be positioned vertically, horizontally or any angle in-between, there are brackets on the market that can achieve the desired result. Brackets allow the user to hold a piece of lumber in the proper positon while still being adjustable until permanently secured in place. Once in place, the piece of lumber is fastened to the bracket, which provides additional mechanical support that is greater than simply fastening the piece of lumber directly in place with a screw or nail.

Brackets are especially useful in framing. Whether a roof, wall or floor, brackets provide increased support and make installation faster and easier. There are several types of brackets used in framing, including joist hangers, angled joist hangers, adjustable and non-adjustable post anchors, post-to-beam brackets, framing angles and seismic ties to name a few. Functionally, these brackets are used to accomplish the same goal: to attach a piece of lumber to a plate in a desired position. However, in form, brackets can vary tremendously based on the type of lumber to be fastened using the bracket and its desired final position.

Framing brackets generally comprise a region having between one and three sides to receive a piece of lumber for attachment and which vary in size depending on the piece of lumber the bracket is designed to engage. Framing brackets also possess attachment mechanisms which are used to secure the bracket to a frame or plate.

Speed prongs are pointed outcroppings on the face of a bracket that protrude away from the face and are positioned over an opening in the face of the bracket. Speed prongs are used to temporarily position and secure a bracket for easier and faster installation. Once the bracket is in position, the speed prongs are hammered down through the opening in the bracket face into the piece of lumber, holding it in place until the bracket is permanently attached by screw or nail.

A framing bracket provides advantages over attaching a piece of lumber directly to a frame or plate, for example, a bracket provides additional support to a piece of lumber when used to adjoin the lumber to a frame or plate. However, current framing brackets may require skill to use properly, impeding their use by the average homeowner. Thus, it would be desirable to develop a framing bracket that may readily be used by both the skilled carpenter and the less skilled home renovator.

BRIEF DESCRIPTION OF THE INVENTION

A novel framing bracket has now been developed comprising a housing adapted to receive a piece of lumber, such as a stud, wherein the housing comprises sides which define an enclosed perimeter having opposing first and second openings, and at least two pairs of opposing fastening wings extending from the sides of the housing.

Thus, in one aspect, a framing bracket is provided. The bracket comprises:

i) a housing adapted to receive a piece of lumber, wherein the housing comprises at least two pairs of opposing sides which provide an enclosed perimeter having opposing first and second openings; and ii) at least two pairs of opposing fastening wings, wherein each fastening wing of a first pair of opposing fastening wings extend from an opposing side of a first pair of opposing sides of the housing at the second opening at an angle to the opposing side of the first pair of opposing sides, and each fastening wing of a second pair of fastening wings extend from an opposing side of a second pair of opposing sides of the housing at the second opening in the same plane as the opposing side of the second pair of opposing sides.

This and other aspects of the invention are described herein in detail by reference to the following drawings.

BRIEF DESCRIPTIONS OF THE DRAWINGS

DETAILED DESCRIPTION OF THE INVENTION

Figure 1:
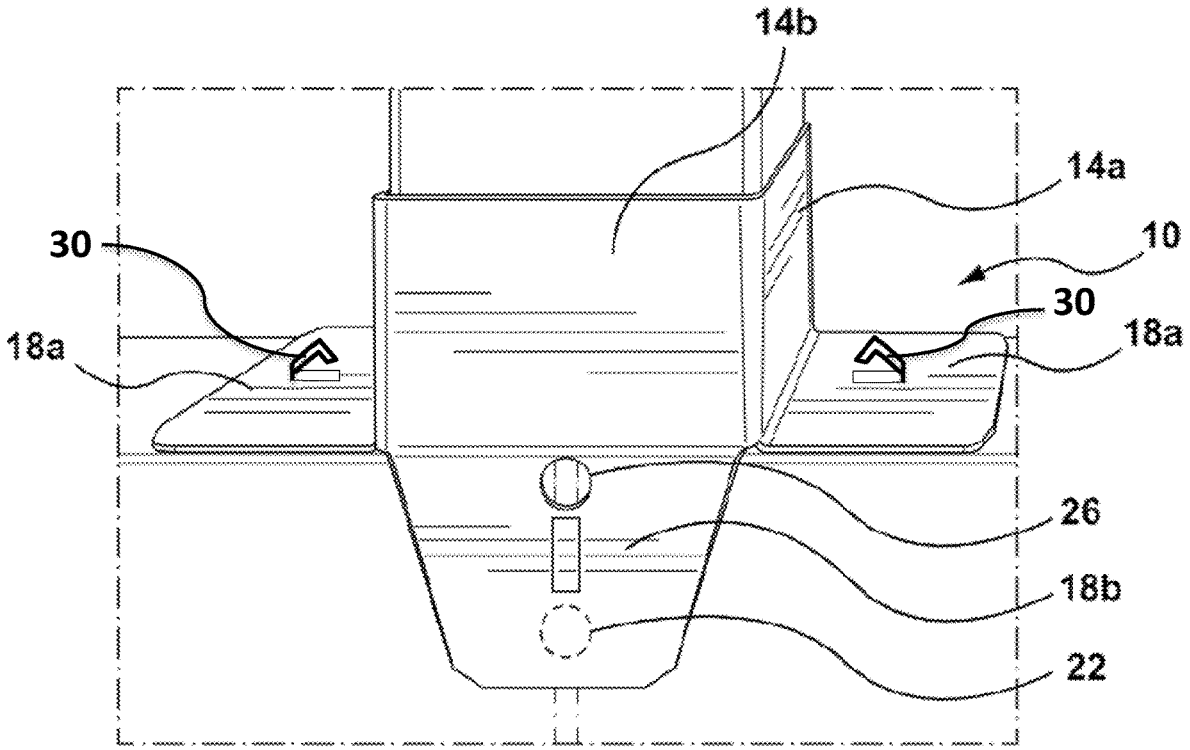
FIG. 1 illustrates a perspective side angle of a framing bracket in accordance with an embodiment positioned to attach a 2×4 piece of lumber in a vertical position to a 2×4 plate.
Figure 2:
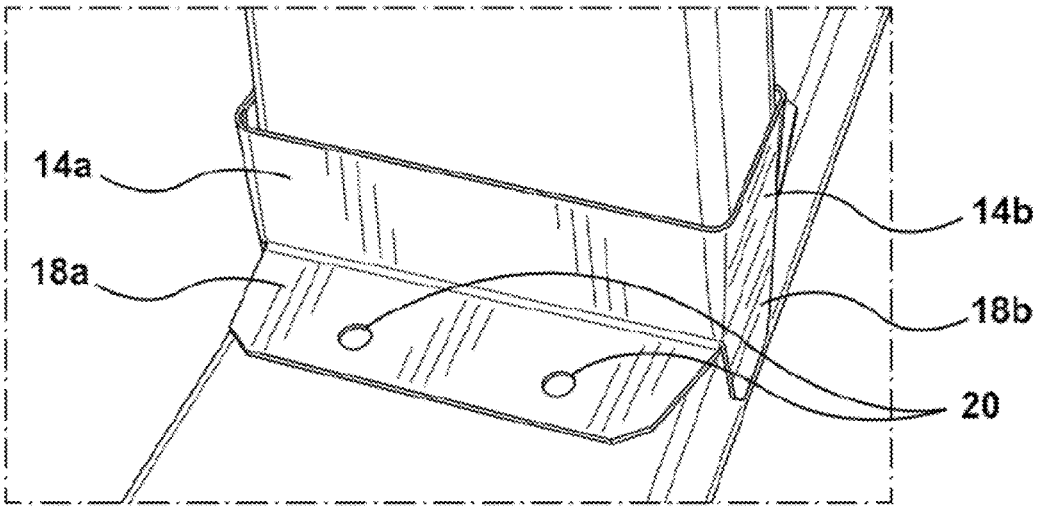
FIG. 2 illustrates a perspective angle from above of a framing bracket in accordance with an embodiment positioned to attach a 2×4 piece of lumber in a vertical position to a 2×4 plate.
Figure 3:
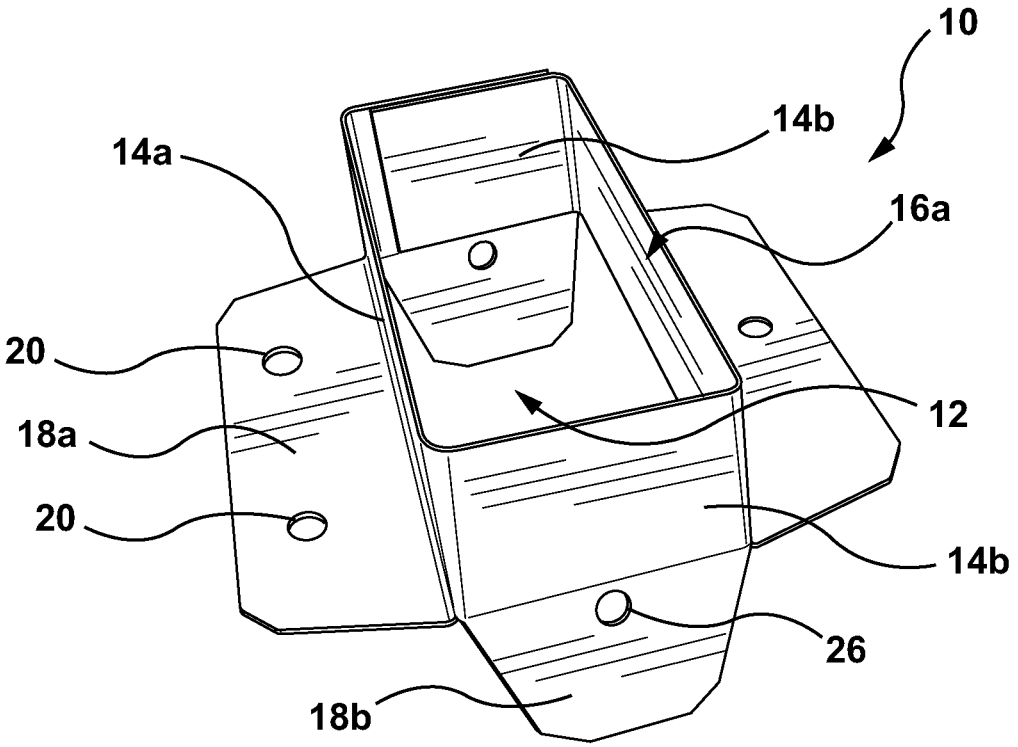
FIG. 3 illustrates a perspective angle from above of a framing bracket in accordance with an embodiment.
Figure 4:
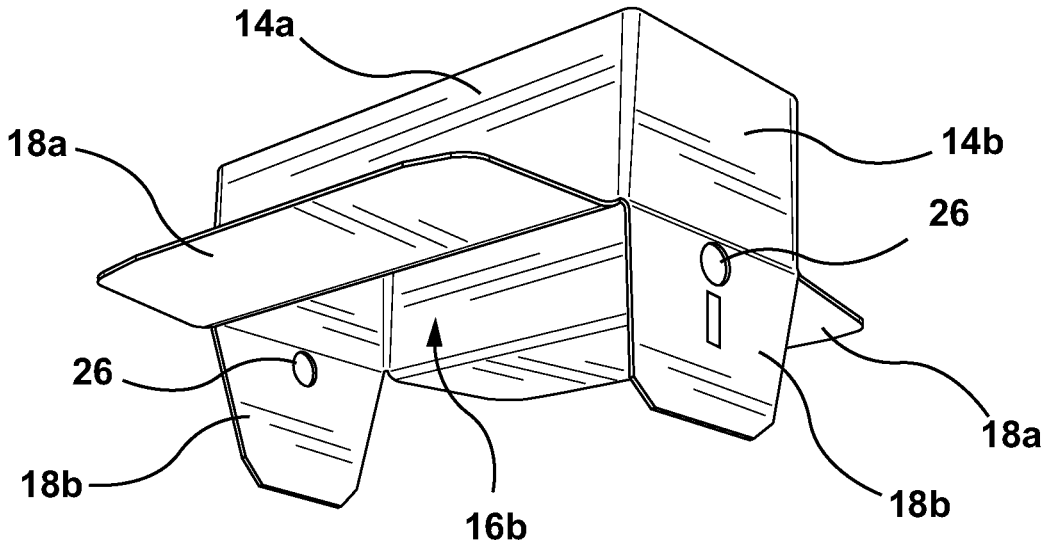
FIG. 4 illustrates a perspective angle from below of a framing bracket in accordance with an embodiment.

A framing bracket (10) is provided comprising i) a housing (12) adapted to receive a piece of lumber, wherein the housing comprises at least 2 pairs of opposing sides (14*a*, 14*b*) which form an enclosed perimeter having opposing first and second openings (16*a*, 16*b*), and ii) at least two pairs of opposing fastening wings (18*a*, 18*b*) extending from opposing pairs of sides of the second opening (16*b*).

The housing (12) of the present bracket (10) comprises at least 2 pairs of opposing sides (14*a*, 14*b*), which form an enclosed perimeter. The enclosed perimeter of the housing (12) comprises opposing first and second openings (16*a*, 16*b*) adapted to receive the end of a given size of lumber. Preferably, the sides (14*a*, 14*b*) of the housing (12) form an enclosed perimeter that provides a friction fit for the piece of lumber for which it was sized. A friction fit is a form of fastening between two tight fitting mating parts, i.e, the housing perimeter and the end of the piece of lumber that produces a joint, which is maintained in position by friction when the parts are pushed together. Thus, the sides (14*a*, 14*b*) of the housing (12) inhibit movement or shifting of the piece of lumber once placed in the housing (12) of the framing bracket (10). Having opposing first and second openings (16*a*, 16*b*) allows the lumber to be received within the housing (12) at the first opening (16*a*) and extends within the housing (12) to the second opening (16*b*) such that it comes into direct contact with a base or plate to which it is to be attached. In an embodiment, the first and second openings are similar in shape and size, or the same.

In addition to the friction fit of the lumber within the housing (12), the depth of the sides (14*a*. 14*b*) of the housing (12) are selected to further stabilize the piece of lumber received within the housing (12). The depth of the sides (14*a*, 14*b*), thus, may vary with the size of the lumber being used. Sides of a greater depth may be required to stabilize lumber having a larger cross-sectional area. However, the depth of the housing sides (14*a*, 14*b*) preferably does not impede receipt of the lumber within the housing (12), for example, the depth of the sides (14*a*, 14*b*) is not too long so as to interfere with receipt of a piece of lumber within the housing (12). In one embodiment, the sides (14*a*, 14*b*) of the housing (12) having a depth of at least about 1 inch to stabilize a stud, such a 2"×4" stud.

The perimeter of the housing (12) at the first and second openings (16*a/b*) may assume various shapes in order to receive various types of lumber. In one embodiment, the perimeter may be rectangular in shape and sized to receive standard lumber sizes such as 2"×2", 2"×3", 2"×4", 2"×6," 4"×4" or any other size of lumber used for framing. In other embodiments, the perimeter is adapted to receive beams, posts, rails, spindles and the like. As one of skill in the art will appreciate, the perimeter does not require strict 90-degree corners. In some embodiments, the corners may be rounded and in other embodiments, the perimeter sides may be rounded as well.

The present framing bracket (10) further comprises at least two pairs of opposing first and second fastening wings (18*a*, 18*b*) extending from opposing sides (14*a*, 14*b*), respectively, of the second opening (16*b*) of the housing (12). The opposing pairs of fastening wings (18*a*, 18*b*) anchor the bracket (10) to a base or plate in two directions. Each opposing pair of fastening wings (18*a*, 18*b*) are oriented differently which allows them to attach to a base or plate on different surfaces thereof, thereby providing anchoring support in multiple directions. This orientation of the two pairs of opposing first and second fastening wings (18*a*, 18*b*) prevents the housing (12) from sliding or twisting. Each fastening wing of the first pair of opposing fastening wings (18*a*) extend from a side of a first pair of opposing sides (14*a*) of the second opening (16*b*) at an angle to the side (14*a*). In an embodiment, the first pair of opposing fastening wings (18*a*) extend from a side of a first pair of opposing sides (14*a*) of the second opening (16*b*) in a direction that is essentially perpendicular to the side (14*a*). Each fastening wing of the second pair of fastening wings (18*b*) extend from a side of the second pair of opposing sides (14*b*) of the second opening (16*b*) along the same plane as the side of the second pair of opposing sides (14*b*). In an embodiment, the first pair of opposing sides (14*a*) are essentially perpendicular to the second pair of opposing sides (14*b*). The opposing pairs of fastening wings are sized to attach to standard lumber sizes such as 2"×2", 2"×3", 2"×4", 2"×6", 4"×4" or any other size of lumber that may be adjoined using the present bracket, preferably without extending beyond the edges of the base or plate to which the lumber is attached. In one embodiment, the fastening wings may be about 1 inch up to about 4 inches long from the side of the housing. As one of skill in the art will appreciate, the first pair of opposing wings (18*a*) may be of a different size to the second pair of opposing wings (18*b*). In addition, each wing of the first opposing pairs of wings (18*a*) may be differently sized, and each wing of the second opposing pairs of wings (18*b*) may be differently sized.

The opposing pairs of fastening wings are shaped to permit stable attachment of the framing bracket to the base or plate to which a piece of lumber (such as a stud) is to be fastened. The shape of the fastening wings may comprise squared edges that line up with the edges of the base/plate, or may comprise rounded or slanted edges that do not line up with the base/plate. The fastening wings may extend from side of the bracket along the full length of a given side (as illustrated in the figures), or may extend from the side of the bracket along only a partial length of a given side provided that the fastening wing provides the requisite stability to the lumber in position within the bracket.

The pairs of opposing first and second fastening wings (18*a*, 18*b*) may optionally each contain at least one pre-drilled hole (20) that allows for a screw, nail, staple or other fastening means to pass through and secure the bracket (10) to a base or plate. Alternatively, the fastening wings (18*a*, 18*b*) may include markings (22) for nail or screw holes to be drilled prior to use, or the bracket (12) may be provided with instructions regarding the placement of nail/screw holes to be drilled into the fastening wings (18*a*, 18*b*).

Each fastening wing of opposing first and second fastening wings (18*a*, 18*b*) may additionally optionally comprise one or more speed prongs (30). The speed prong (30) allows for quick and temporary attachment of the framing bracket to a base, plate or to the lumber, which in turn enables the user to use both hands to permanently attach the lumber to a base or plate.

The pairs of opposing first and second fastening wings (18*a*, 18*b*) are not limited in design to be fastened to a plate that has flat, level and square surfaces. As one skilled in the art would appreciate, the pairs of opposing first and second fastening wings (18*a*, 18*b*) may be designed to fasten the framing bracket (10) to a plate which is not level, having some degree of curvature or which surface is uneven and comprises bumps, indents or other irregularities.

To aid in placement of the framing bracket (10), the housing (12) may have one or more viewing windows (26). e.g. a hole formed in the bracket, that permits the user to position the bracket at a particular, predetermined site on the plate. The user, thus, may mark the desired location for the center of the framing bracket (10) on the base or plate, and place the bracket (10) in position by viewing the mark through the viewing window (26) on the bracket. The viewing window (26) may be positioned at any appropriate place on the bracket (10) that permits positioning of the bracket (10). In one embodiment, the viewing window (26) is positioned centrally within one or both fastening wings of the second pair of fastening wings (18*b*) which are in the same plane as the housing sides (14*b*).

The present framing bracket (10) is made of a material appropriate for use as a building material, including wood, metal, plastic and composite materials. In one embodiment, the framing bracket is made of galvanized steel which offers advantages over other materials such as low manufacture costs, reliable protection against corrosion and long life expectancy. Galvanized steel also has a high shear strength in comparison to other materials, as well as high standard yield strength and tensile strength. Different parts of the framing bracket (10) may be made of different materials, for example, the housing (10) may be made of galvanized steel, while the fastening wings (18*a*, 18*b*) are made of a different material. Preferably, the framing bracket (10) is made entirely of the same material, and is thus, integrally formed.

Figure 5:
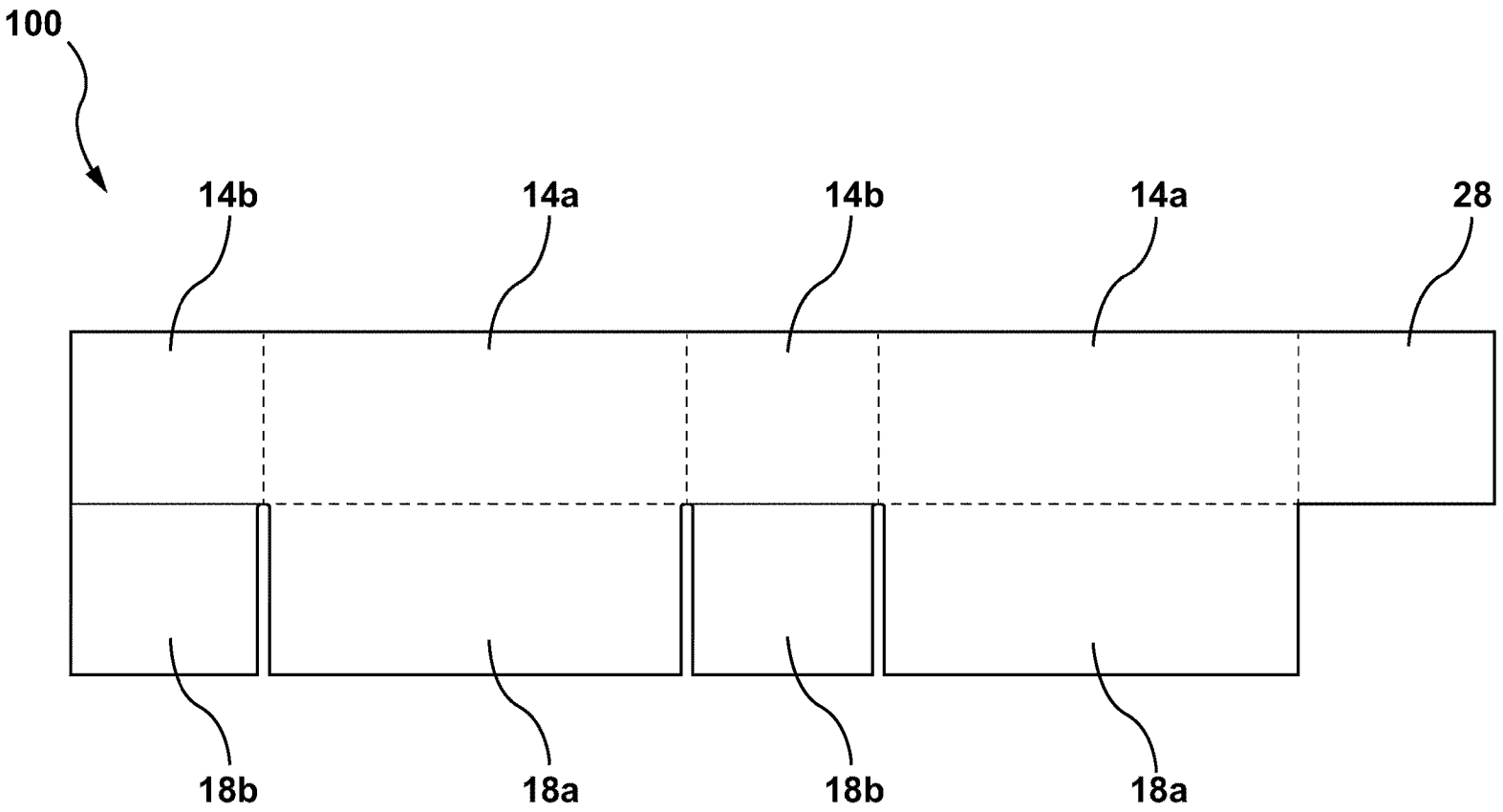
FIG. 5 illustrates a blank for use to prepare a framing bracket in accordance with an embodiment.

While a fully intact framing bracket according to the invention is preferred, it is envisioned that the bracket (10) may be adapted to provide a housing which is open at one or more sides, but which is adapted to be closed around the end of a piece of lumber to form an enclosed perimeter by the use of a mechanism such as a latching mechanism, adhesive, magnetism, speed prong(s), welding or the like. In one embodiment, a blank (100) for use to form the bracket (10) is provided, as represented in FIG. 5. The blank is a flattened template comprising the sides (14*a*, 14*b*) and fastening wings (18*a*, 18*b*) of the framing bracket such that on molding the blank by bending along indicated joints, the framing bracket is formed. In such an embodiment, the bracket (10) may include an additional side (28) which, when all opposing sides (14*a*, 14*b*) are folded (at the dashed lines) into position, overlaps an opposing side (14*b*) to form the housing (12). The additional side (28) is fastened to the opposing side (14*b*) which it overlaps through welding, adhesives, mechanical or any other appropriate means. The fastening wings (18*a*) are folded into position such that they are at an angle which will allow for the opposing fastening wings (18*a*) to be securely fashioned to the base or plate. As known in the art, blank (100) may be formed using a mechanical blanking press or laser blanking technology.

During installation of the framing bracket (10), the housing (12) of the bracket (10) receives a piece of lumber for which it is sized. The first opening (16*a*) of the framing bracket (10) first receives the end of the piece of lumber, which passes through the housing (12) to the second opening (16*b*) from which the opposing pairs of first and second fastening wings (18*a*, 18*b*) extend. Once the piece of lumber is in position, the framing bracket is positioned such that the first and second fastening wings (18*a*, 18*b*) are in contact with the base or plate to which the piece of lumber is to be attached. The bracket is positioned and fastened in place using speed prongs or any other method appropriate for temporarily fastening the framing bracket (10) to the plate. Once temporarily fastened, the piece of lumber can be permanently fastened to the base or plate. To fasten the piece of lumber to the plate, multiple mechanisms can be used. In embodiments, nails or screws can be inserted above the sides (14*a*, 14*b*) of the housing (12), and angled downward such that the nails or screws penetrate both the piece of lumber and the plate, a method called toenailing. In another embodiment the sides (14*a*, 14*b*) of the housing (12) possess a hole which allows a screw or nail to pass through and penetrate the piece of lumber. In yet another embodiment, at least one domed nailing guide formed on at least one side (14*a*, 14*b*) of the housing (12) allows for a nail or screw to pass through the side (14*a*, 14*b*) of the housing (12) at an angle appropriate to penetrate both the piece of lumber and the plate.

The present novel framing bracket (10) provides numerous advantages over traditional framing brackets available on the market. An advantage provided by the framing bracket (10) is that it enables professionals and amateur builders alike to quickly and easily temporarily place a piece of lumber such as a stud stably in position on a base or plate, permitting the user to use two hands to permanently fix the stud in place. To provide this stability, the bracket (10) comprises pairs of fastening wings (18*a*, 18*b*) oriented in different positions against the base or plate to which the lumber is to be fastened. In addition, the enclosed housing (12) of the present framing bracket (10) may be adapted to provide a friction fit between the piece of lumber and the bracket and/or to provide other attaching means (such as speed prongs). Not only does this provide additional support to the joint, but also prevents side-to-side movement which causes wear on the piece of lumber. Having an enclosed perimeter housing also prevents the piece of lumber from twisting or loosening from its permanently fastened location, providing support in different orientations to the base.

The invention claimed is:

1. A framing bracket consisting of:

i) a housing configured to receive a piece of lumber, wherein the housing having sides which define an enclosed perimeter and opposing first and second openings; and ii) at least two pairs of opposing fastening wings extending from opposing pairs of sides at the second opening, wherein each fastening wing of a first pair of opposing fastening wings extend from a side of a first pair of opposing sides of the second opening at an angle to the sides of the housing, and each fastening wing of a second pair of fastening wings extend from a side of a second pair of opposing sides of the second opening along a same plane as the side of the second pair of opposing sides, wherein one or more of the first and second fastening wings having at least one speed prong located thereon, wherein the framing bracket is integrally formed from a single piece of material.

2. The framing bracket according to claim 1, wherein the first pair of opposing sides is perpendicular to the second pair of opposing sides.

3. The framing bracket according to claim 1, wherein each fastening wing of the first pair of opposing fastening wings is perpendicular to the side of the first pair of opposing sides from which each fastening wing extends.

4. The framing bracket according to claim 1, wherein the sides of the housing having a depth of about 1 to 4 inches.

5. The framing bracket according to claim 1, wherein the first and second openings of the housing are adapted to receive lumber of a size selected from 2"×2", 2"×3", 2"×4", 2"×6" and 4"×4".

6. The framing bracket according to claim 1, wherein the first and second pairs of fastening wings are adapted to fasten the bracket to lumber of a size selected from 2"×2", 2"×3", 2"×4", 2"×6" and 4"×4".

7. The framing bracket according to claim 1, wherein the material is galvanized steel.

8. The framing bracket according to claim 1, wherein the bracket is configured as a blank, the blank being a flattened template of said material for use to prepare the bracket.

9. A framing bracket consisting of:

i) a housing configured to receive a piece of lumber, wherein the housing having sides which define an enclosed perimeter and opposing first and second openings; and ii) at least two pairs of opposing fastening wings extending from opposing pairs of sides at the second opening, wherein each fastening wing of a first pair of opposing fastening wings extend from a side of a first pair of opposing sides of the second opening at an angle to the sides of the housing, and each fastening wing of a second pair of fastening wings extend from a side of a second pair of opposing sides of the second opening along a same plane as the side of the second pair of opposing sides, wherein one or more of the first and second fastening wings having at least one speed prong located thereon, wherein the framing bracket is integrally formed from a single piece of material, wherein at least one of the first or the second pair of fastening wings extend from the side of the bracket along only a partial length thereof.

10. A framing bracket consisting of:

i) a housing configured to receive a piece of lumber, wherein the housing having sides which define an enclosed perimeter and opposing first and second openings; and ii) at least two pairs of opposing fastening wings extending from opposing pairs of sides at the second opening, wherein each fastening wing of a first pair of opposing fastening wings extend from a side of a first pair of opposing sides of the second opening at an angle to the sides of the housing, and each fastening wing of a second pair of fastening wings extend from a side of a second pair of opposing sides of the second opening along a same plane as the side of the second pair of opposing sides, wherein one or more of the first and second fastening wings having at least one speed prong located thereon, wherein the framing bracket is integrally formed from a single piece of material, wherein one or more of the first and second fastening wings having at least one pre- drilled hole.

11. A framing bracket consisting of:

i) a housing configured to receive a piece of lumber, wherein the housing having sides which define an enclosed perimeter and opposing first and second openings; and ii) at least two pairs of opposing fastening wings extending from opposing pairs of sides at the second opening, wherein each fastening wing of a first pair of opposing fastening wings extend from a side of a first pair of opposing sides of the second opening at an angle to the sides of the housing, and each fastening wing of a second pair of fastening wings extend from a side of a second pair of opposing sides of the second opening along a same plane as the side of the second pair of opposing sides, wherein one or more of the first and second fastening wings having at least one speed prong located thereon, wherein the framing bracket is integrally formed from a single piece of material, wherein one or more of the first and second fastening wings having at least one marking to indicate where to make a hole.

12. A framing bracket consisting of:

i) a housing configured to receive a piece of lumber, wherein the housing having sides which define an enclosed perimeter and opposing first and second openings; and ii) at least two pairs of opposing fastening wings extending from opposing pairs of sides at the second opening, wherein each fastening wing of a first pair of opposing fastening wings extend from a side of a first pair of opposing sides of the second opening at an angle to the sides of the housing, and each fastening wing of a second pair of fastening wings extend from a side of a second pair of opposing sides of the second opening along a same plane as the side of the second pair of opposing sides, and a viewing window formed in one or both of the second pair of fastening wings, wherein one or more of the first and second fastening wings having at least one speed prong located thereon, wherein the framing bracket is integrally formed from a single piece of material.

13. A framing bracket consisting of:

i) a housing configured to receive a piece of lumber, wherein the housing having sides which define an enclosed perimeter and opposing first and second openings; and ii) at least two pairs of opposing fastening wings extending from opposing pairs of sides at the second opening, wherein each fastening wing of a first pair of opposing fastening wings extend from a side of a first pair of opposing sides of the second opening at an angle to the sides of the housing, and each fastening wing of a second pair of fastening wings extend from a side of a second pair of opposing sides of the second opening along a same plane as the side of the second pair of opposing sides, wherein one or more of the first and second fastening wings having at least one speed prong located thereon, wherein the framing bracket is integrally formed from a single piece of material, wherein one or more of the opposing sides of the bracket having a hole to receive a nail or screw.

14. A framing bracket consisting of:

i) a housing configured to receive a piece of lumber, wherein the housing having sides which define an enclosed perimeter and opposing first and second openings; and ii) at least two pairs of opposing fastening wings extending from opposing pairs of sides at the second opening, wherein each fastening wing of a first pair of opposing fastening wings extend from a side of a first pair of opposing sides of the second opening at an angle to the sides of the housing, and each fastening wing of a second pair of fastening wings extend from a side of a second pair of opposing sides of the second opening along a same plane as the side of the second pair of opposing sides, wherein one or more of the first and second fastening wings having at least one speed prong located thereon, wherein the framing bracket is integrally formed from a single piece of material, wherein one or more of the opposing sides of the bracket having a domed nailing guide that is offset from a center thereof.

15. A method of attaching a stud to a base consisting of:

placing the framing bracket as defined in claim 1 on an end of the stud, positioning the stud within the framing bracket on the base, fixing the framing bracket to the base, and fastening the stud to the base.

* * * * *